United States Patent [19]

Tilly et al.

[11] 4,445,439

[45] May 1, 1984

[54] RAILROAD VEHICLE TRUCK WITH SINGLE WHEELSET

[75] Inventors: Lynn K. Tilly, West Chicago; John J. Sawa, Chicago, both of Ill.

[73] Assignee: AMSTED Industries Incorporated, Chicago, Ill.

[21] Appl. No.: 302,217

[22] Filed: Sep. 14, 1981

[51] Int. Cl.[3] ..... B61F 3/00; B61F 5/22; B61F 5/44

[52] U.S. Cl. ..... 105/165; 105/199 S; 105/208; 105/213; 105/453; 267/4

[58] Field of Search ..... 105/165, 182 R, 199 S, 105/206 A, 206 R, 224 R, 208, 212, 213, 214; 267/4

[56] References Cited

U.S. PATENT DOCUMENTS

| | | | |
|---|---|---|---|
| 1,427,060 | 8/1922 | Broussouse et al. | 267/4 X |
| 2,354,458 | 7/1944 | Hammerstrom | 267/4 |
| 2,961,974 | 11/1960 | Seelig, Jr. | 105/199 S X |
| 4,339,996 | 7/1982 | Brodeur et al. | 105/199 S X |

*Primary Examiner*—Randolph Reese
*Assistant Examiner*—Howard Beltran
*Attorney, Agent, or Firm*—Edward J. Brosius; Fred P. Kostka

[57] ABSTRACT

A railroad vehicle truck having a single wheelset includes a pair of spaced side frames. The side frames are joined into a rigid unit by a pair of transversely positioned crossbars. The crossbars are positioned one each on each side of the wheelset which has its axle ends journaled in bearings carried in turn in a pedestal jaw centrally formed in each side frame. Projecting inwardly from each end of the side frames is a bracket which forms part of a set of upper pivot connections with an upper end of a swing arm. A laterally positioned crosstie assembly is joined through a pair of spaced end caps with a lower end of each swing arm to form a set of lower pivot connections. Each crosstie assembly end cap has a pair of spring cups containing a set of springs which operatively support a body of the railroad vehicle thereabove.

6 Claims, 7 Drawing Figures

RAILROAD VEHICLE TRUCK WITH SINGLE WHEELSET

BACKGROUND OF THE INVENTION

1. Field of the Invention

This invention relates to trucks for railroad vehicles and more particularly to a truck having a single wheelset.

2. Prior Art

Traditionally, a truck for use with a railroad vehicle has at least a pair of spaced wheelsets and is commonly referred to as "a 4-wheel truck". Even wheelset comprises two wheels joined to a free axle wherein the wheels and respective axle rotates as a unit. Such trucks were developed to support considerable loads and today are available with rated capacities of 100 tons or greater.

When the railroad vehicle is not required to carry such heavy loads, for example in passenger service or piggy-back type service of automotive trailers or containers, then the load carrying capacity of the truck may be reduced substantially.

One suggested railroad vehicle truck particularly adapted for lighter loads includes a single wheelset. The wheelset has its axle ends rotatively journaled in bearings. The bearings in turn operatively connect through an adapter to a centrally located pedestal jaw integrally formed as part of each of a pair of spaced longitudinally positioned side frames.

At each side frame end is an inwardly projecting bracket which in turn pivotally supports an upper end of a swing arm. Positioned laterally between the front and rear swing arm pairs is a crosstie assembly. Each assembly has a pair of end caps which pivotally connect respectively with a lower end of each swing arm pair.

Because the upper side frame bracket-swing arm pivot connections are located apart at a lesser distance than the crosstie assembly end cap-swing arm pivot connections, the crosstie assembly is self-leveling. Each crosstie assembly end cap has a pair of cups which contain lower ends of set of springs. Upper ends of the spring sets are operatively connected to a body of the railroad vehicle and resiliently support such.

The railroad truck as described above in theory provides certain advantages over the traditional 4-wheel truck. First, the mass of the truck is reduced. This lesser mass between the track and the car body reduces track wear and reduces the energy required to move the railroad vehicle body associated with the truck. This mass can be further minimized by using components having an optimum strength-to-weight ratio.

The railroad vehicle truck as described, however, has not been built and tested to prove its ability to operate satisfactorily in the harsh environment of railroading. To evaluate the structural integrity of the design prior to actual fabrication and field testing, the various components were studied using computerized finite element analysis. This analysis revealed that the initial design of the side frames and crosstie end caps could be expected to fail when subjected to static and dynamic forces which the truck would typically encounter during use.

SUMMARY OF THE INVENTION

According to this invention there is provided an improved truck for a railroad vehicle; the truck has a pair of crosstie assemblies defined in part by a pair of spaced end caps each having a center block operatively connected to a side frame of the truck by a swing arm, and each end cap has a pair of spring cups attached one each to each side of the center block; each spring cup is operatively connected to a body of the railroad vehicle by a resilient device and each end cap includes inner and outer ribbing which is joined to each cup and which extends from the center block above and below the cups respectively to resist bending forces transferring between the center block and the spring cups; the end cap further including a transverse rib joined to and extending across each cup and located between the center block and an outermost edge point of the cup to resist torsional forces transferring between the center block and the spring cups.

The invention may further be provided to include the inner ribbing being joined to an inner flange of each spring cup and the outer ribbing being joined to an outer edge of each spring cup. In a preferred embodiment of the invention the inner ribbing has an outer end which is located in proximate alignment with the outermost edge point with a top edge of the inner ribbing sloping upward from the outer end to an inner end which is substantially flush with a top wall of the center block. Further, the outer ribbing has an outer end which is located in proximate alignment with the outermost edge point with a bottom edge of the outer ribbing sloping downward from the outer end to an inner end which is substantially flush with a bottom wall of the center block.

This invention produces certain improved results. To appreciate these improved results it should be understood that a structurally sound end cap is provided by insuring that no portion of the end cap is stressed beyond a yield point of that particular end cap portion. Preferably all levels of stress within the end cap are maintained sufficiently below the yield point to afford a reasonable margin of safety. The amount of such stress is directly proportional to the magnitude of the force applied to the end cap and is indirectly proportioned to the physical configuration of the end cap portion. The magnitude of the force applied to the end cap cannot be readily changed without a major modification to the design of the truck. On the other hand, a mere increase in the mass of the end cap is contra to the objective of minimizing the mass of the truck.

The ribbing as described above optimizes the end cap in that the structure is sound and the mass is a minimum.

DESCRIPTION OF THE PREFERRED EMBODIMENT

Figure 1:
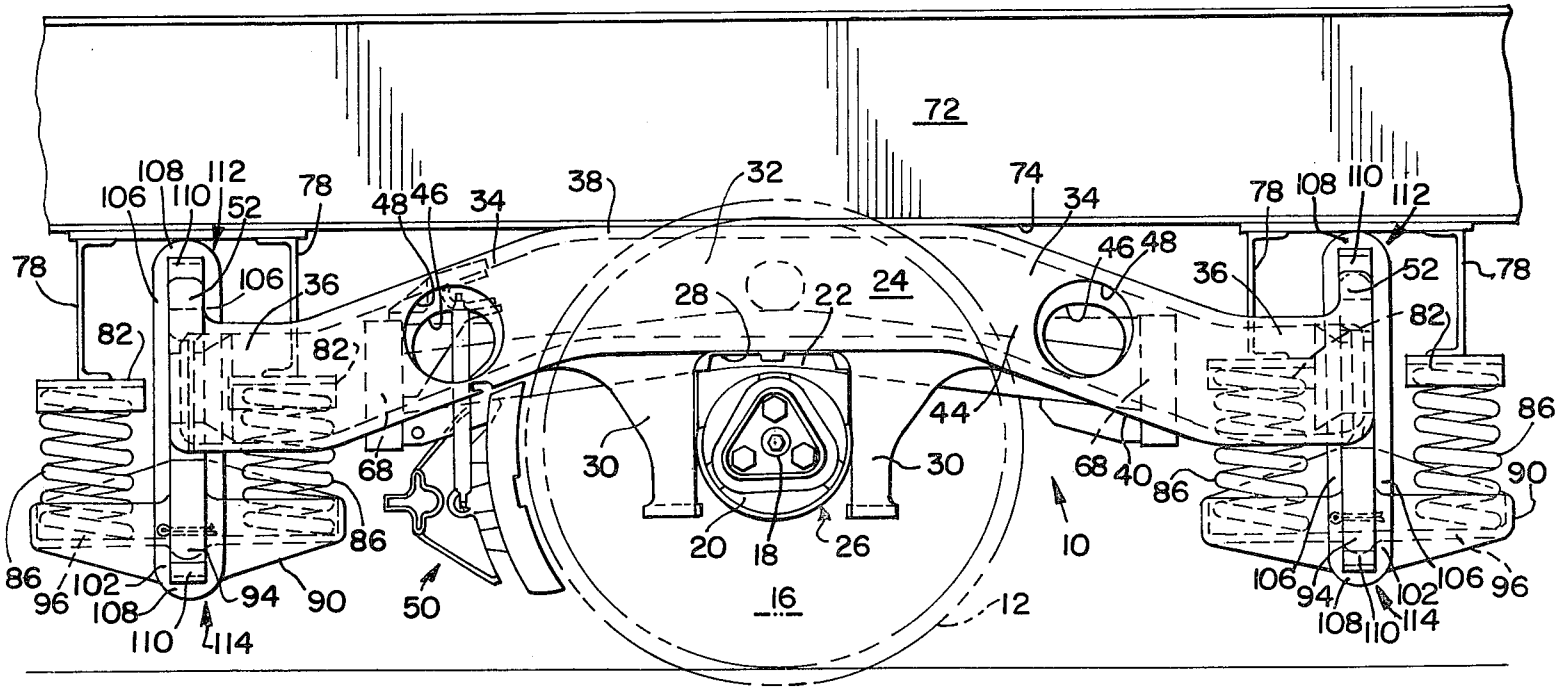
FIG. 1 is a side elevation view of a railroad car truck incorporating this invention.
Figure 2:
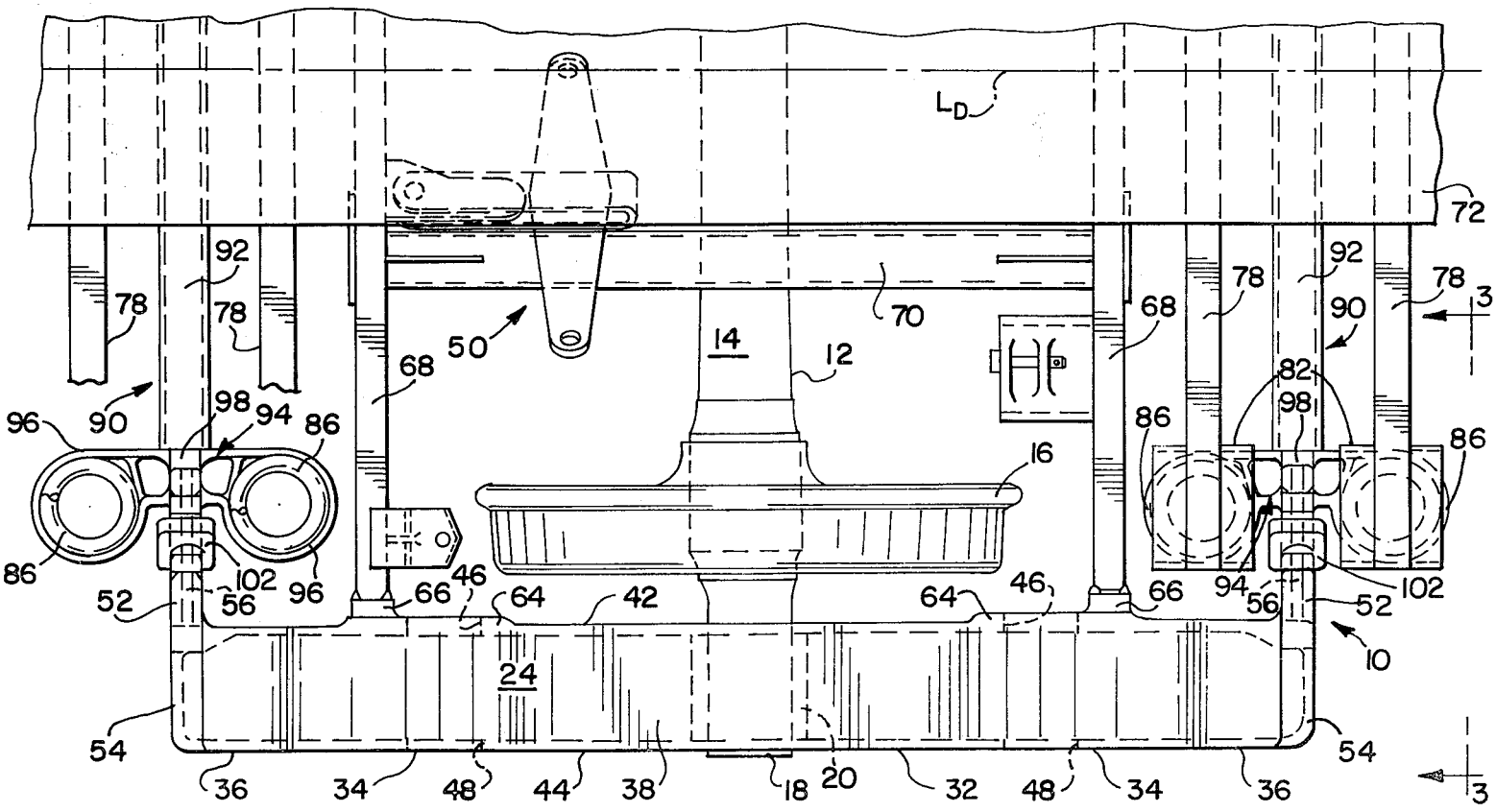
FIG. 2 is a partial plan view of the truck of FIG. 1 with an upper portion of the truck selectively cutaway.
Figure 3:
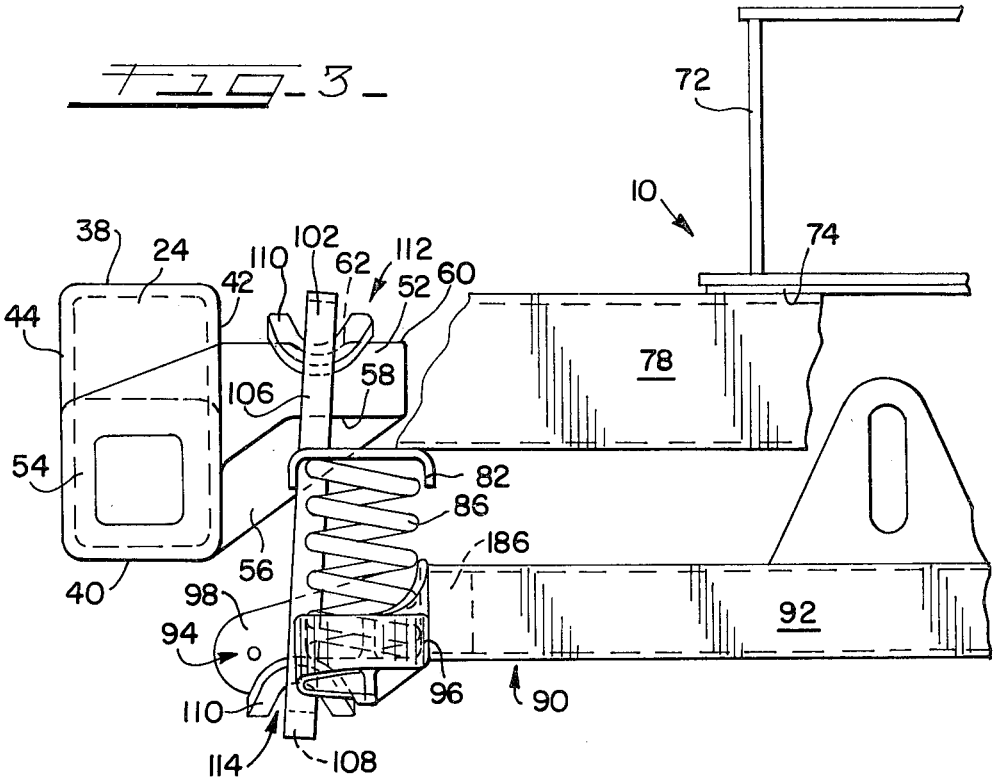
FIG. 3 is an end elevation view as seen generally along the line 3—3 of FIG. 2 with a selective portion of the truck cutaway.
Figure 4:
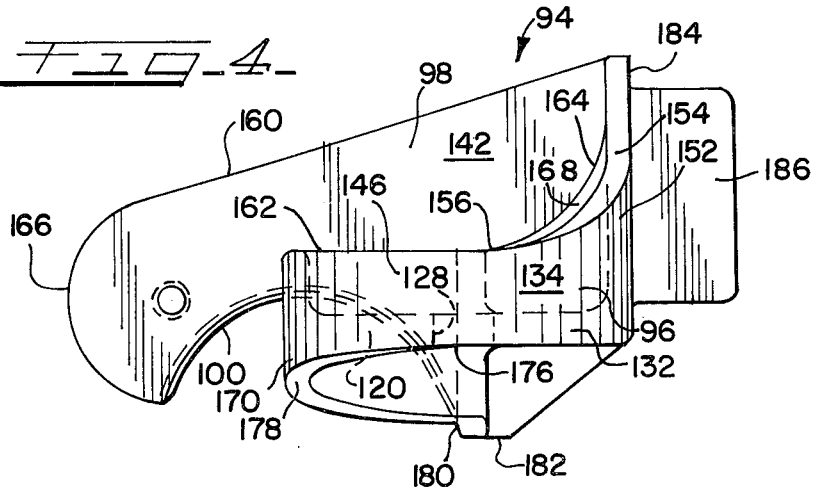
FIG. 4 is a side elevation view of an end cap forming part of a crosstie assembly of the truck of FIGS. 1, 2 and 3.
Figure 5:
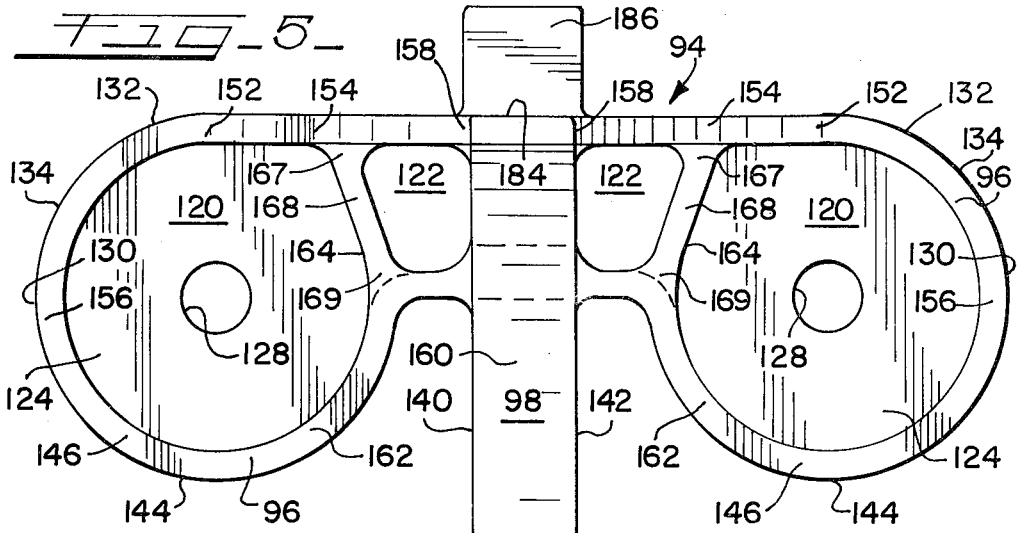
FIG. 5 is a top plan view of the end cap of FIG. 4.
Figure 6:
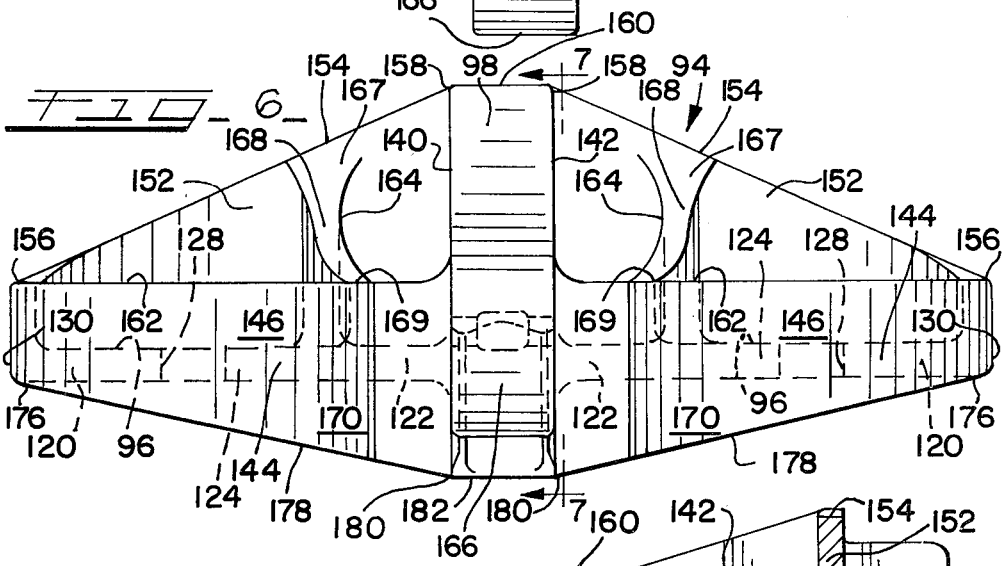
FIG. 6 is an elevation view of an outer end cap of FIG. 5.
Figure 7:
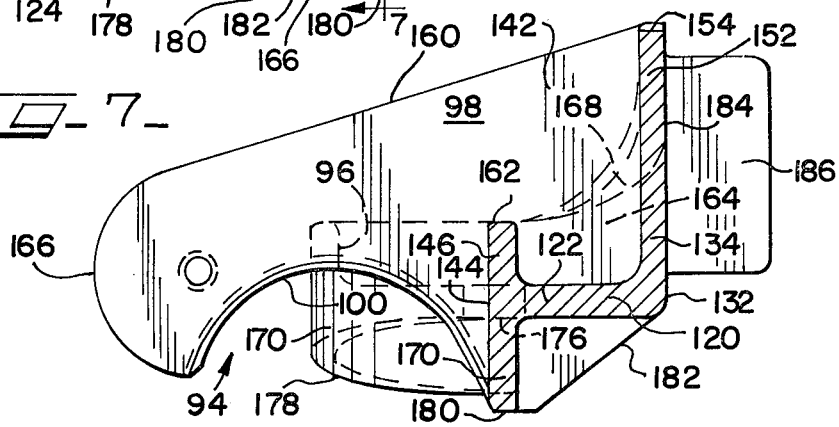
FIG. 7 is a cross section side elevation view of the end cap as seen generally along the line 7—7 of FIG. 6.

A railroad car truck incorporating this invention is shown generally in FIGS. 1–3 and designated 10. The truck 10 includes a wheelset 12 comprising a free axle 14 with a pair of spaced wheels attached thereto. Only one such wheel 16 is shown in FIG. 2. The structure of the truck 10 is symmetrical with respect to its longitudinal axis LD and therefore only one half of the truck 10 is shown.

An axle end 18 of the wheelset 12 is journaled in a bearing 20 in a known manner. An adapter 22 operatively connects the axle end 18 and the bearing 20 to a side frame 24. The adapter 22 is positioned within a pedestal jaw 26 defined by a flat roof 28 and spaced end portions 30. The pedestal jaw roof 28 and end portions 30 are formed as an integral part of the side frame 24.

The side frame 24 has a gull wing-like configuration defined by an upper middle portion 32 which is joined at each end by downwardly sloped intermediate portions 34. Ends of the sloped intermediate portions 34 in turn connect with lower outer portions 36. The side frame 24 has a generally hollow cross-section configuration comprising a top and bottom wall 38, 40 joined by spaced inner and outer side walls 42, 44. In each side wall 42, 44 and located in each side frame intermediate portion 34 is an inner opening 46 and outer opening 48 which provide access to brake rigging shown generally and designated 50.

As best seen in FIGS. 2 and 3, projecting inwardly at ends of each side frame outer portion 36 is a bracket 52 having an offset configeration. The bracket 52 is formed as an integral part of an end wall 54 of the side frame 24 and includes a vertical reinforcing rib 56. The rib 56 joins a bottom surface 58 of the bracket 52 and the inner side wall 42 of the side frame 24. A top surface 60 of each bracket 52 is formed with a radiused groove 62.

On the inner sidewall 42 of the side frame 24 is a pair of spaced raised portions 64 which extend from about each inner opening 46 and include a boss 66. Attached to each boss 66 is an end of a transom cross bar 68. It should be understood that the cross bars 68 extend laterally across the truck 10 with an opposite end of each connecting with like boss formed on the other side frame (not shown). The cross bars 68 join the side frames into a rigid unit. To provide further stiffness a pair of longitudinal bracing members connect the cross bars 68 with one such member 70 shown in FIG. 2.

A body of the railroad vehicle (not shown in detail) may include a longitudinal underframing support 72 shown in FIGS. 1 and 3. Affixed to a bottom surface 74 of the support 72 are two pairs of laterally positioned channels 78. Attached at an outer end of each pair of channels 78 is a pair of upper spring cups 82 which contain upper ends of a set of coil springs 86.

Positioned laterally on each side of the wheelset 12 is a crosstie assembly 90. Each crosstie assembly 90 comprises a middle tubular portion 92 having its ends joined to spaced end caps 94. Each end cap 94 is formed with a pair of spring cups 96 in which in turn loosely hold lower ends of the set of springs 86. Positioned between the spring cups 96 and attached thereto is a center block 98. The center block 98 is formed with a downward facing radiused groove 100.

Each crosstie assembly 90 is operatively connected to the side frames by a pair of swing arms, and in FIGS. 1 and 2 for example, two of the four swing arms are shown and designated 102. Each swing arm 102 has an elongated looplike configuration defined by a pair of straps 106 which are joined by upper and lower cross pieces 108. Each cross piece 108 forms a seat for a bushing 110, see FIGS. 1 and 3, which interface between the side frame bracket radiused groove 62 and the crosstie assembly end cap radiused groove 100 to form an upper and lower pivot connection 112, 114. These pivot connections 112, 114 allow the crosstie assemblies 90 to swing laterally to accommodate like movements of the body of the railroad vehicle. Note that the upper pivot connections 112 are inwardly offset from the lower pivot connections 114. This offset produces a self-leveling effect to resist the swing action of the crosstie assemblies 90 transferred from like movements of the railroad vehicle body during travel thereof.

To best understand the construction of the crosstie assembly end cap 94 it is suggested that FIGS. 4–7 be viewed concurrently with the written description below. As was noted earlier, each end cap 94 includes a pair of spring cups 96 positioned on each side of the center block 98.

Each spring cup 96 is defined in part by a horizontal platform 120 comprising a narrow partition 122 located adjacent to and joined integrally to the center block 98. Connecting with each platform narrow portion 122 is a circular cup portion 124. Centrally located in each platform circular cup portion 124 is a drainage opening 128.

Extending from an outermost edge point 130 of each platform 120 above an inner edge 132 of the platform 120 is an inner flange 134. The inner flanges 134 are integrally joined to a front and rear vertical side wall 140, 142 of the end cap center block 98 respectively.

Also extending from the outermost edge point 130 of each platform 120 above an outer edge 144 of the platform 120 is an outer flange 146. Each outer flange 146 also is integrally joined to the front and rear vertical sidewall 140, 142 of the end cap center block 98 respectively.

Above each inner flange 134 and formed integrally therewith is an inner rib 152. Each inner rib 152 is defined in part by a top edge 154 having an outer end 156 which is located proximate the outermost edge point 130. The top edge 154 slopes upwardly from the outer end 156 to terminate at an inner end 158 which is substantially flush with a top wall 160 of the end cap center block 98. Top edges 162 of the outer flanges 146 are substantially horizontal.

Between each set of inner and outer flanges 134, 146 is a transverse rib 164. Each transverse rib 164 is angularly offset so that if a longitudinal axis of each were extended, the axes would intersect at a point proximate an outer end wall 166 of the end cap center plate 98. Each rib 164 is in substantial alignment with a joinder of the platform narrow partition 122 and circular cup portion 124. An inner end 167 of the transverse rib 164 is joined in part to the inner flange 134 while an outer end 169 is joined to the outer flange 146. A top edge 168 of each transverse rib 164 slopes upward from the outer end 169 to the inner end 167.

Extending from the outermost edge point 130 of each platform 120 below the platform outer edge 144 is an outer rib 170. Each outer rib 170 has an outer end 176 which is located proximate the outermost edge point 130. A bottom edge 178 slopes downwardly from the outer end 176 to terminate at an inner end 180 where the bottom edge 178 is substantially flush with a bottom wall 182 of the end cap center block 98. The rib inner ends 180 are joined integrally with the center block sidewalls 140, 142 respectively. Attached to an inner end wall 184 of the center block 98 is a boss 186 which may be inserted into the crosstie assembly middle tubular member 92 to aid in assembly.

During operation of a railroad vehicle which would include a set of the trucks 10 located one each at respective end of the vehicle, each truck 10 is subjected to dynamic and static forces. These forces are multi-directional in nature and produce shear, bending, tensile, compressive and torsional stresses in the various truck component. One such force is vertical in direction and comprises a static component which is gravity generated from a weight of the vehicle body and its related load. The other component of this vertical force is dynamic in nature and results from changes in the absolute and relative vertical location of the truck 10 and the vehicle body. These dynamic related forces are inherent in movement of the vehicle over track. These vertical forces pass through the springs 86 and are increased or decreased by the dynamic component depending upon the respective concurrent relative upward or downward movement of the body of the vehicle and the truck 10.

Also during travel of railroad vehicle the railroad vehicle body rolls and pitches in response to changes in velocity and changes in direction, for example, about a curved section of track. Such rolling movements are translated in part into a sideway swinging or lateral oscillating movement of vehicle body. Such movements and related forces are transferred by the springs 86 to the crosstie assemblies 90 which may swing as provided by the upper and lower pivot connections 112, 114 between the side frame brackets 52, the swing arms 102 and the crosstie assemblies 90 respectively.

Note that in the crosstie end cap 94 the point at which the forces are effectively transferred, i.e. line of force, between the spring 86 and the end cap 94 is a proximate center of the spring cup 96. On the other hand the effective point of transfer i.e. line of force, between the swing arm 102 and the end cap 94 is a center of the center block radiused groove 100. These lines of force are spaced apart longitudinally and laterally. The longitudinal spacing creates a force moment which produces bending stresses in the spring cups 96. On the other hand the lateral spacing creates a force moment which produces torsional or twisting stresses in the spring cups 96. These stresses are particularly concentrated at a joinder of the platform narrow partition 122 with the end cap center plate 98.

The inner ribs 152 and the outer ribs 170 insure that these bending related stresses are maintained at a level below the yield point of the cross section of the structure. The transverse rib 164 on the other hand is particularly useful in maintaining the torsional related stresses below the yield point of the structure. The net result is that ribs 152, 164 and 170 insure that the end cap 92 remains structurally sound during operation of the truck 10 while at the same time the strength-to-weight ratio of the end cap 94 is optimized.

What is claimed is:

1. A truck for a railroad car, said truck having a pair of crosstie assemblies defined in part by a pair of endcaps, each of said endcaps having a center block operatively connected to a side frame of said truck by a swing arm and having at least two spring cups attached one each to each side of said center block, said spring cups operatively connected to a body of said railroad car by resilient means, an improvement in said endcap comprising:

inner and outer rib means joined to each said spring cup and extending from said center block above and below said cups respectively to resist bending forces transferring between said center block and said spring cups, transverse rib means joined to and extending across each said spring cup and located between said center block and an outermost edge point of said spring cup to resist torsional forces transferring between the center block and the spring cups, said inner rib means joined to an inner flange of each said spring cup and said outer rib means joined to an outer edge of each said spring cup, said inner rib means having an outer end located near said outermost edge of said spring cup and a top edge sloping upwardly from said outer end to an inner end flush with a top wall of said center block.

2. A truck for a railway car, said truck having a pair of crosstie assemblies defined in part by a pair of endcaps, each of said endcaps having a center block operatively connected to a side frame of said truck by a swing arm and having at least two spring cups attached one each to each side of said center block, said spring cups operatively connected to a body of said railroad vehicle by resilient means, an improvement in said endcap comprising:

inner and outer rib means joined to each said cup and extending from said center block above and below said cups respectively to resist bending forces transferring between said spring cups, transverse rib means joined to and extending across each said spring cup and located between said center block and an outer edge of said spring cup to resist torsional forces transferring between the center block and the spring cups, said outer rib means having an outer end located near said outer edge of said cup and a bottom edge sloping downward from said outer end to an inner end substantially flush with a bottom wall of said center block.

3. The truck for a railway car of claim 2 wherein said transverse rib means has an outer end joined to an outer flange formed about an outer edge of said cup and an inner end joined in part to said inner rib means.

4. The truck for a railway car of claim 2 wherein said transverse rib means has a top edge substantially flush with a top edge of said outer flange at the outer end of the transverse rib means with said top edge sloping upward therefrom to be substantially flush with a top edge of said inner rib means at said inner end.

5. The truck for a railway car of claim 2 wherein each said transverse rib means located at an angle with respect to said center block with a longitudinal axis of each said transverse rib means intersecting at a point near an outer end wall of said center block.

6. An end cap particularly adapted for being part of a crosstie assembly in a railroad vehicle truck with a single wheelset, an improvement of said end cap comprising, a center block having a bottom wall formed with a downward concave shaped groove to form in part a lower pivot connection with a swing arm of said truck, and a pair of horizontal platforms attached to and extending outwardly respectively from each side of said center block, each said platform including a narrow partition located adjacent to said center block and joined integrally thereto and a circular cup portion connecting with said narrow partition, an inner flange joined to and extending upwardly from and about an inner edge of each said horizontal platform, an outer flange joined to and extending upwardly from and about an outer edge of said horizontal platform, an inner rib formed on each said inner flange, said inner ribs having an outer end proximate to an outermost edge point of each said horizontal platform and an inner end joined to a front and a rear vertical sidewall of said center block respectively with said inner ribs having a top edge sloping upwardly from said outer end to said inner end to be substantially flush with a top wall of said center block, an outer rib joined to and extending downward from and about said outer edge of each said horizontal platform, said outer ribs having an outer end proximate to said outermost edge point of each said horizontal platform and an inner end joined to said front and rear sidewall of said center plate respectively with said outer ribs having a botom edge sloping downward from said outer end to said inner end to be substantially flush with a bottom wall of said center block, and a transverse rib formed on and extending upward from each said platform, each said transverse rib being proximately aligned with a joinder of said platform narrow partition and said platform circular cup portion with a top edge of each said transverse rib being substantially flush with a top edge of said outer flange at an outer end of said transverse rib, said top edge of said transverse ribs sloping upward from said outer ends to be substantially flush with said top edge of said inner ribs at an inner end of each said transverse rib with a longitudinal axis of each said transverse rib intersecting a longitudinal axis of said center block at a point proximate an outer end wall of said center block.

* * * * *